US006315282B2

(12) United States Patent
Chua et al.

(10) Patent No.: US 6,315,282 B2
(45) Date of Patent: Nov. 13, 2001

(54) APPARATUS AND A METHOD FOR PICKING MULTIPLE-SIZED MEDIA SHEETS

(75) Inventors: Ching Yong Chua; Ah Chong Johnny Tee; Seng Lim Richard Wu; Pui Wen Huang, all of Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/102,203

(22) Filed: Jun. 22, 1998

(30) Foreign Application Priority Data

Jun. 27, 1997 (SG) ..... 9702285-9

(51) Int. Cl.[7] ..... B65H 3/52
(52) U.S. Cl. ..... 271/121; 271/248
(58) Field of Search ..... 271/121, 124, 271/248, 250, 145, 167

(56) References Cited

U.S. PATENT DOCUMENTS 5,004,217 * 4/1991 Kano et al. ..... 271/121
5,292,117 * 3/1994 Takagi et al. ..... 271/248
5,857,671 * 1/1999 Kato ..... 271/121
5,884,908 * 3/1999 Kato ..... 271/119

FOREIGN PATENT DOCUMENTS

0171734 * 7/1988 (JP) ..... 271/121
403267228 * 11/1991 (JP) ..... 271/121
405201570 * 8/1993 (JP) ..... 271/121
406144620 * 5/1994 (JP) ..... 271/121
406179540 * 6/1994 (JP) ..... 271/121

* cited by examiner

*Primary Examiner*—H. Grant Skaggs

(57) ABSTRACT

An apparatus capable of performing pick operations on multiple sizes in a printing device is disclosed. This apparatus separates a media sheet from a stack and drives it along a media path. The apparatus also corrects any pick skew of the media sheet caused during the pick operation before the media sheet is transferred to the drive roller. By ensuring that the traversing media sheet has a leveled leading edge, the pick skew of the media sheet is substantially eliminated.

14 Claims, 12 Drawing Sheets

APPARATUS AND A METHOD FOR PICKING MULTIPLE-SIZED MEDIA SHEETS

FIELD OF THE INVENTION

The present invention relates generally to media handling in printing devices. In particular, it relates to an apparatus and a method, capable of handling multiple media sizes, for picking a media sheet from a stack substantially squared to a media path and substantially eliminating the pick skew of the media sheet in the media path.

BACKGROUND OF THE INVENTION

Many different kinds of hardcopy printing devices are available commercially today, and these include copiers, faxes and printers. Ubiquitous hardcopy printing devices such as printers are commonly found in homes and offices. Since the evolution of office automation, printers have been integrally connected with other office automation equipment like computers, workstations, print servers, or networks to provide hardcopy printing capability. With the advent of increased CPU processing speed and power due to fast-paced technological advancement, better computers, workstations and servers have also come into being. Thus, that complementing equipment such as printers too must have increased throughput in order to contribute to the overall productivity of any office automation system is inevitable.

Printers commonly use printing paper of various sizes, transparencies, or even postcards as print media. These media sheets are fed sequentially into these printers to receive print markings. In doing so, the throughput of the printer is thus limited, in part, by the rate at which the printer receives the media sheets. Many known methods are currently implemented in commercially available printers to handle and provide media sheets efficiently to these printers for printing.

An example of the implementation of such known methods is the pick-and-feed operation of many ink jet printers. A pick operation entails picking a single media sheet from a stack of media sheets and moving it along a media path through the use of a pick roller. A drive roller and a pinch roller, which cooperate to perform a feed operation, controls the positioning of the media sheet with respect to a printing head for receiving print markings. In some ink jet printers, the pick-and-feed operation is performed by the same roller serving both the pick and drive functions for cost reasons. From the perspective of performance however, a pick roller would require a different type of material from that of a driver roller. For high pick reliability, the pick roller should be made of soft rubber with high friction coefficient. Conversely, the rubber used for the drive roller should be hard so that it does not deform easily and thus is able to control the feeding of the media sheet accurately. Therefore the implementation of a common roller to perform both operations may not meet the need for both reliable and accurate media handling.

Some ink jet printers, on the other hand, make use of separate pick and drive rollers to achieve reliable and accurate media handling. This type of implementation, however, can present its own set of problems, especially during the design of a pick system for resiliently handling various sizes of media sheets. This set of problems can exist because such a pick system for multiple sized media sheets is usually susceptible to the occurrence of pick skew of the different sizes of media sheets. If the media sheet is skewed, then the print markings received on the media sheet will not be square to the page and the result will be aesthetically displeasing.

The present invention is intended to provide a solution to various prior art deficiencies, which include those present with the existing printing devices such as copiers, faxes or printers, to provide a cost effective and reliable media sheet pick operation within a media handling system.

SUMMARY OF THE INVENTION

In a preferred embodiment, the present invention provides an apparatus, capable of handling multiple media sizes, for picking a media sheet from a stack substantially squared to a media path and substantially eliminating the pick skew of the media sheet in the media path. The apparatus comprises a rotating pick roller, and the pick roller rotates in an axis substantially orthogonal to the media path. The apparatus also comprises a separator which is raised from the surface of the media path. Accordingly, the rotating pick roller and the separator cooperate to provide parallel and opposing forces to separate the media sheet from the stack and move the media sheet along the media path. The apparatus further comprises a novel series of raised leveling surfaces on the surface of the media path. The leveling surfaces help to eliminate the pick skew by raising and leveling the leading edge of the media sheet.

The present invention also provides a method, capable of handling multiple media sizes, for picking a media sheet from a stack squared to a media path and the elimination of the pick skew of the media sheet in the media path. The method comprises the step of cooperatively using the pick roller and separator to apply parallel and opposing forces to separate the media sheet from a stack. The method also comprises the step of leveling the leading edge of the media sheet to eliminate the pick skew.

DESCRIPTION OF THE PREFERRED EMBODIMENT

Overview

The main reason for using separate pick and drive rollers in a printing device is to increase the reliability of the pick operation of the printing device, as mentioned in a preceding section. In the following sections, a preferred embodiment of the invention shall be described, by way of an example, as an independent pick system for picking multiple sized media sheets for use in an ink jet printer.

Figure 1:
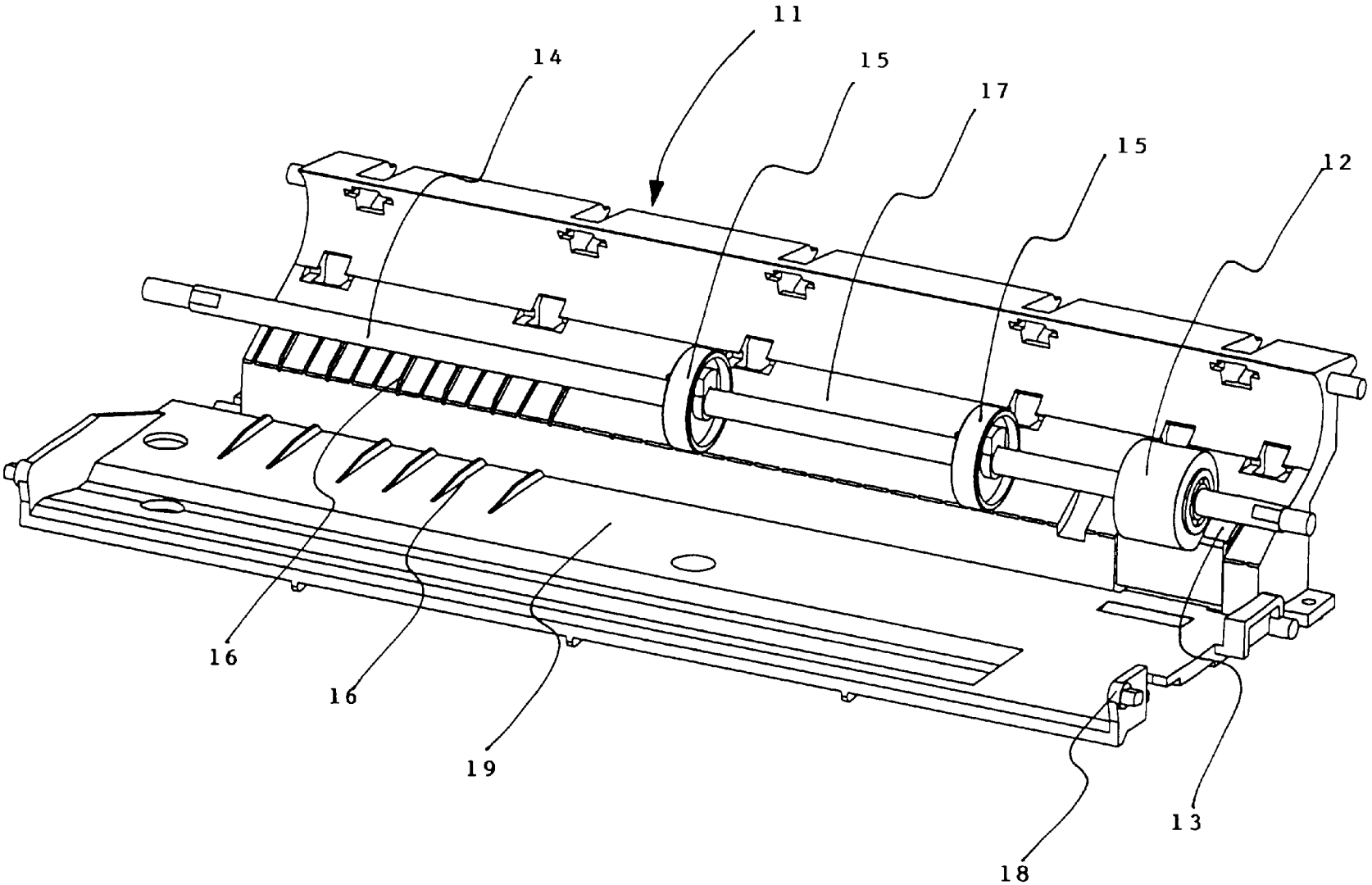
FIG. 1 is an isometric view of the preferred embodiment of the present invention.
Figure 2:
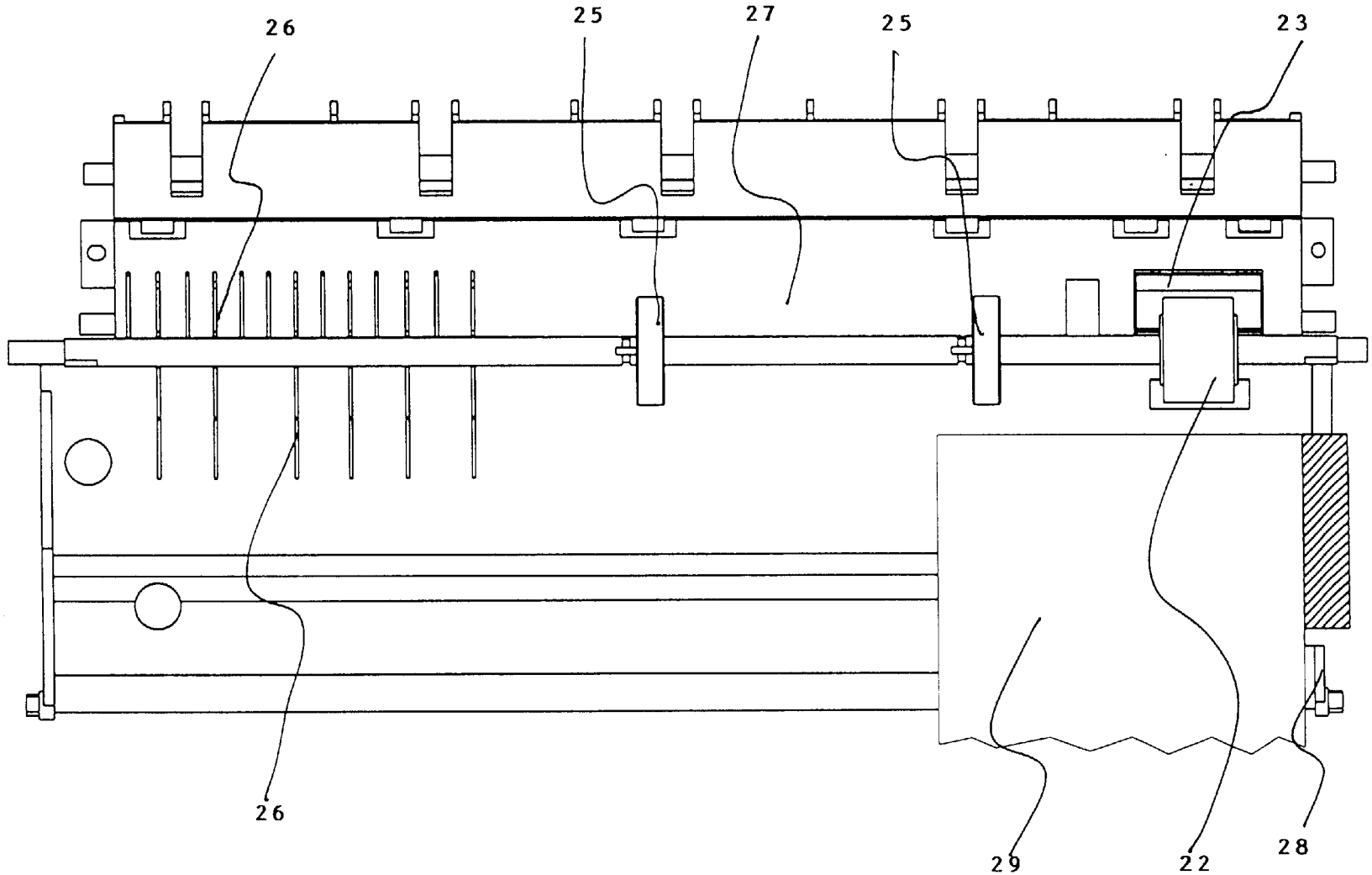
FIG. 2 is a plan view of the embodiment in FIG. 1 for use with known postcard-size print media.
Figure 3:
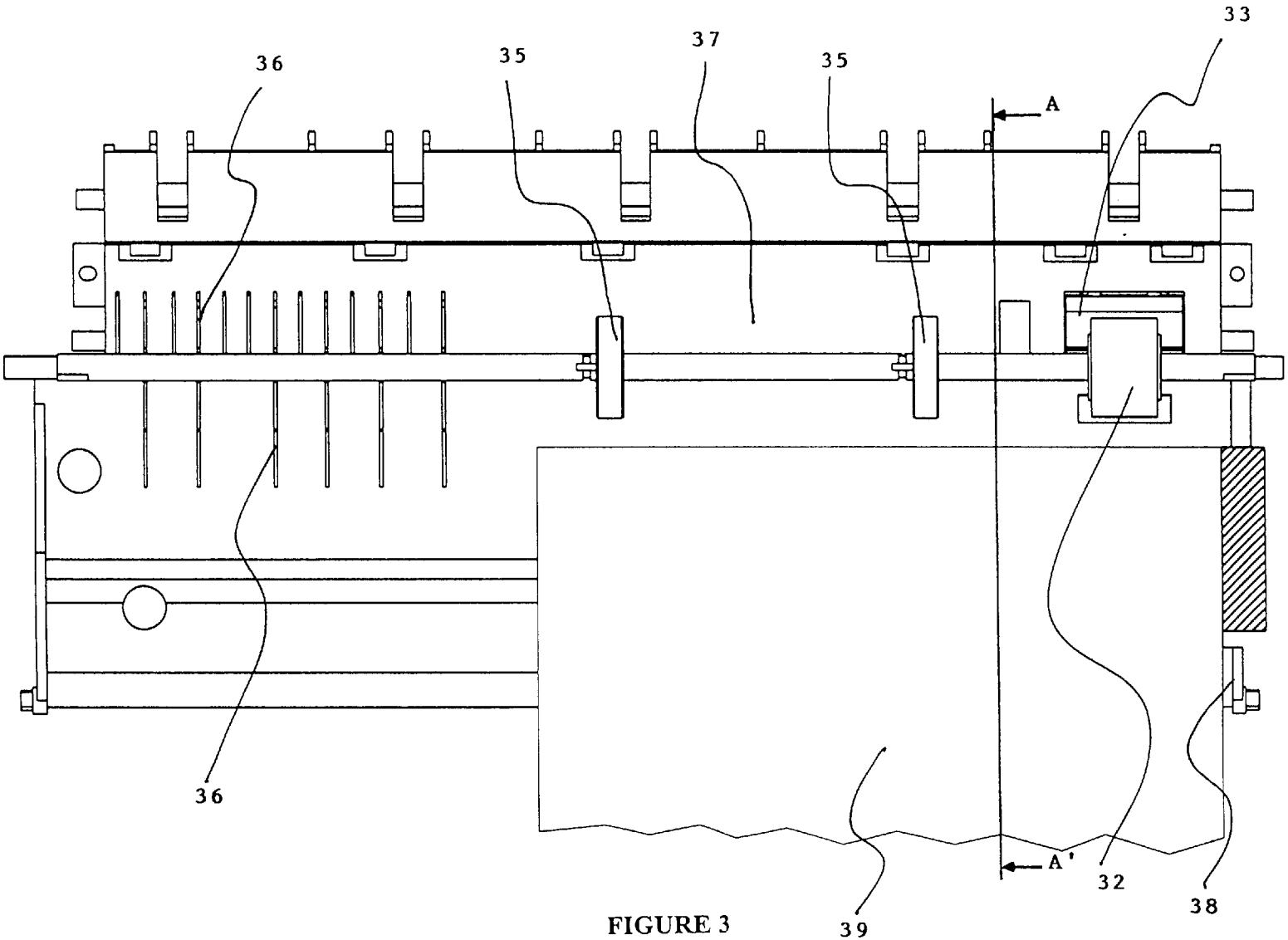
FIG. 3 is a plan view of the embodiment in FIG. 1 for use with known A-size print media.
Figure 4:
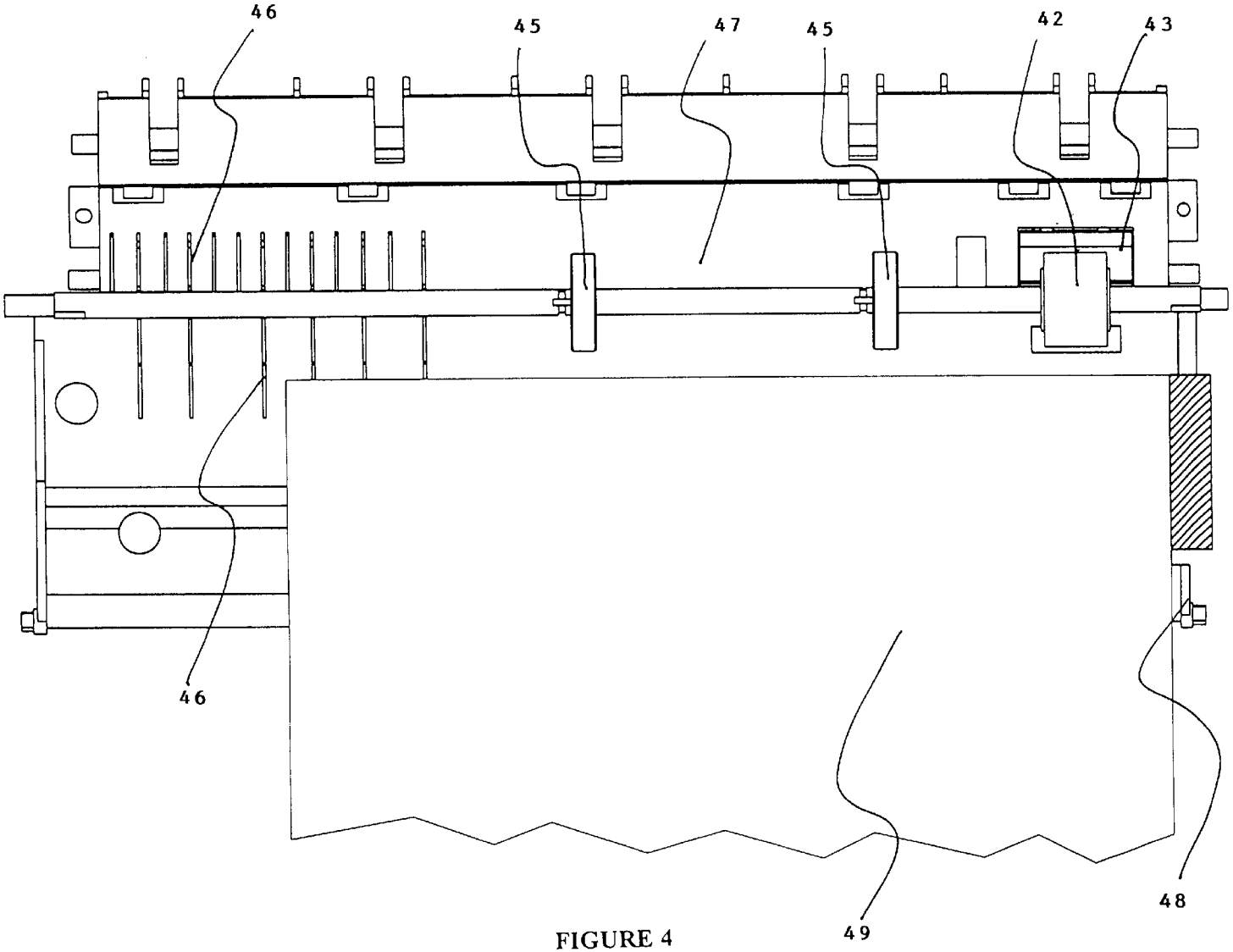
FIG. 4 is a plan view of the embodiment in FIG. 1 for use with known A3-size print media.
Figure 5:
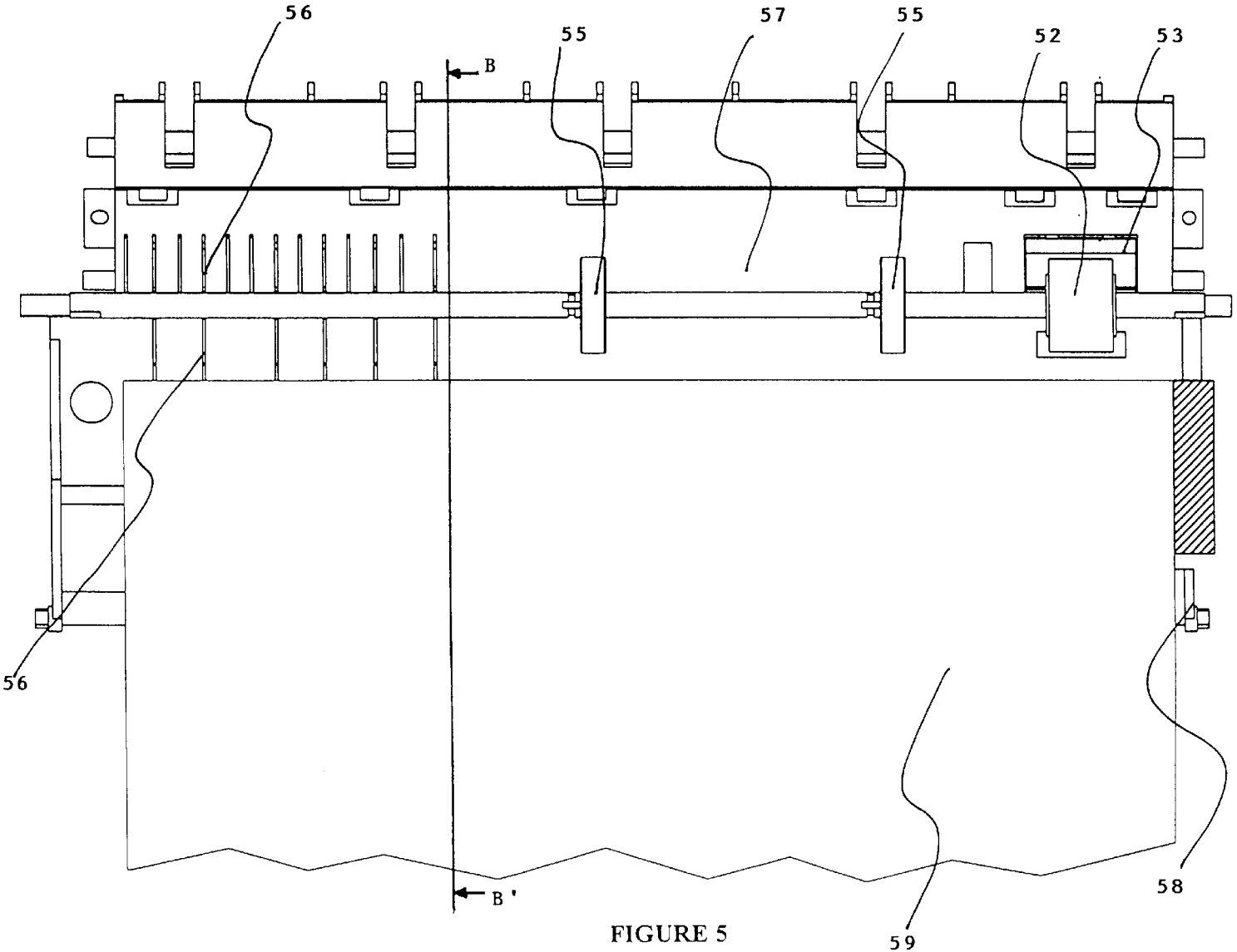
FIG. 5 is a plan view of the embodiment in FIG. 1 for use with known Super B-size print media.

In FIG. 1 the preferred embodiment, which is a pick system 11, is essentially formed with a pick roller 12, a separator 13 (partially hidden by pick roller 12), a shaft 14, a pair of idle rollers 15, a series of leveling ribs 16, and a media path 17.

The pick system 11 forms an integral part of the ink jet printer, which is partially shown in FIG. 1. A stack of media (not shown) to be used for printing is placed in an input tray 19 (partially shown). The stack of media is also squared to the media path 17 and aligned to a right datum 18 of the media path 17. The media handling process begins with the pick system 11 picking media sheets (also not shown), one at a time, from the stack in the input tray 19 and moving the media sheet along the media path 17 to a drive roller-pinch roller entry point (not shown). The media sheets will subsequently be fed into position, by the drive roller and pinch roller, for receiving print markings.

The pick roller 12 is fixed to the shaft 14, which drives and rotates it. The pair of idle rollers 15 are also spaced along and connected to the shaft 14. However, the idle rollers 15 are connected such that they freely rotate about the shaft 14, and thus are not driven by the shaft 14. The shaft 14, and thus the rotational axis of the pick roller 12 and the pair of idle rollers 15, is placed perpendicular to the media path 17 and parallel to a leading edge of the media sheet. This arrangement is necessary because the pick roller 12 will initially come into contact with the leading edge of the media sheet and subsequently drive the media sheet, keeping it substantially squared, along the media path.

The separator 13 is found directly below the pick roller 12 along the media path 17. This arrangement allows the separator 13 to cooperate with the pick roller 12 to pick a single sheet of media sheet from the stack. The series of leveling ribs 16 are found on the surfaces of the input tray 19 and media path 17. These ribs 16 are strategically located adjacent to the separator 13 and beneath the length of the shaft 14 on the surface of media path 17. Independently, the series of leveling ribs 16 and the pair of idle rollers 15 perform pick skew correction for the different sizes of media sheets. Details of this operation will be further explained in later sections.

Figure 6:
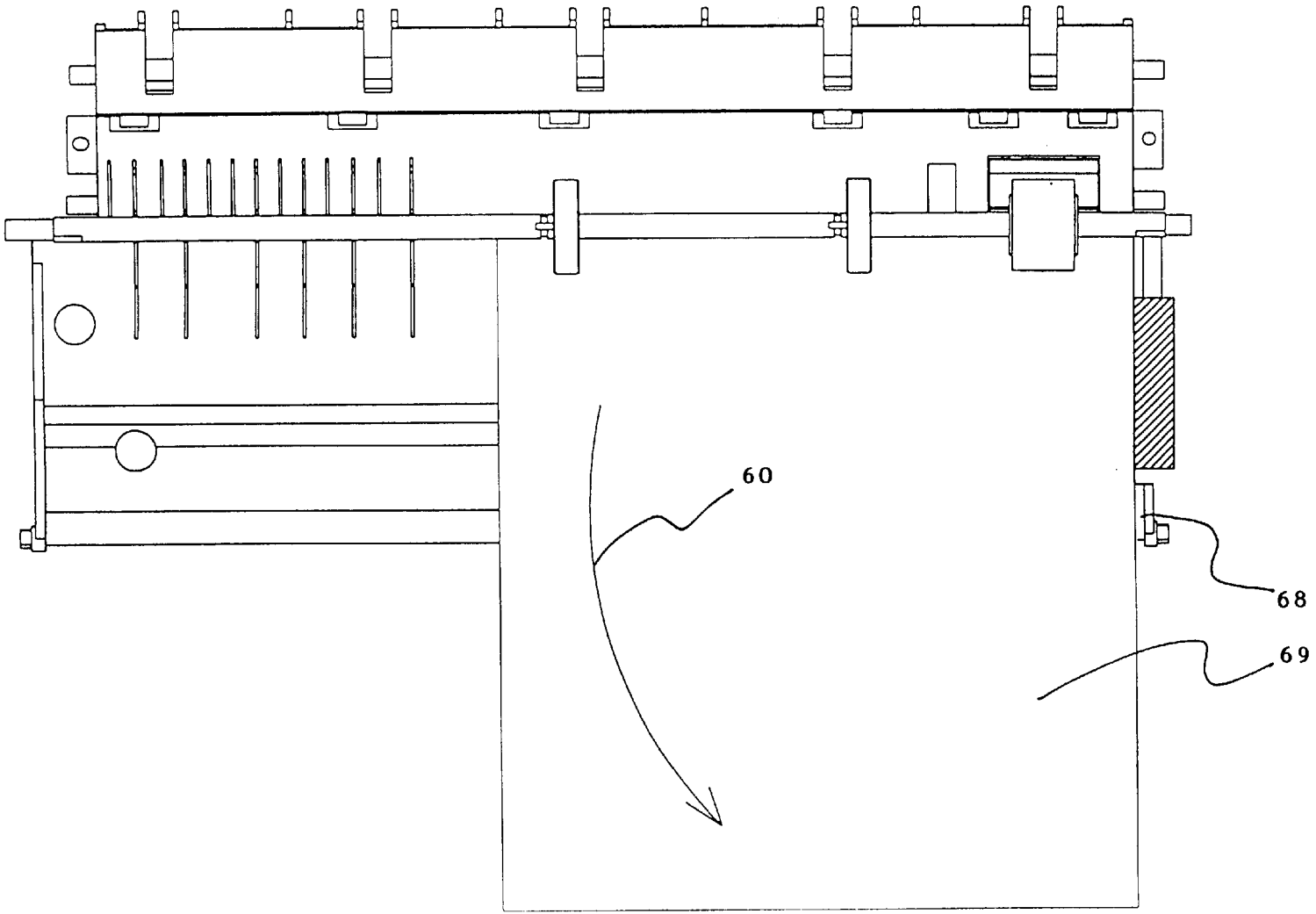
FIG. 6 is another plan view of the embodiment in FIG. 1.

In FIGS. 2 to 5, which are the plan views of the embodiment in FIG. 1, demarcations for the different sizes of media sheets 29, 39, 49 and 59 used by the ink jet printer are shown. These demarcations are used to indicate the leading edges and part of the left edges of the different types of media sheets 29, 39, 49 and 59, or stacks of them, when their right edges are aligned with the right data 28, 38, 48 and 58 respectively. Media sheet 29 is commonly known as postcard-size print media; media sheet 39 as A-size print media; media sheet 49 as A3-size print media; and media sheet 59 as Super-B size print media. The most important common feature among all of the views shown by FIGS. 2 to 5 is the position of the different media sheets 29, 39, 49 and 59, or stacks of them, with reference to the respective media paths 27, 37, 47 and 57. By aligning all the different sizes of media to the right of the media paths 27, 37, 47 and 57, and thus against the right data 28, 38, 48 and 58 respectively, the use of a single pick roller-separator configuration for multiple sized media sheets pick operation is made possible. This economy of parts is usually a desired arrangement because of obvious cost advantages. This configuration, however, causes the media sheet 29, 39, 49 and 59 to rotate in an anti-clockwise direction due to imbalancing forces acting on it as it is pulled at the right leading edge by the pick rollers 22, 32, 42 and 52 during the pick operation. This behaviour is illustrated in FIG. 6, in which the media sheet 69 experiences a rotational force 60 as result of the imbalancing forces. The right datum 68 however, prevents the media sheet 69 from rotating and contributing to the pick skew, by providing an equal and opposite force to the rotational force.

Figure 7:
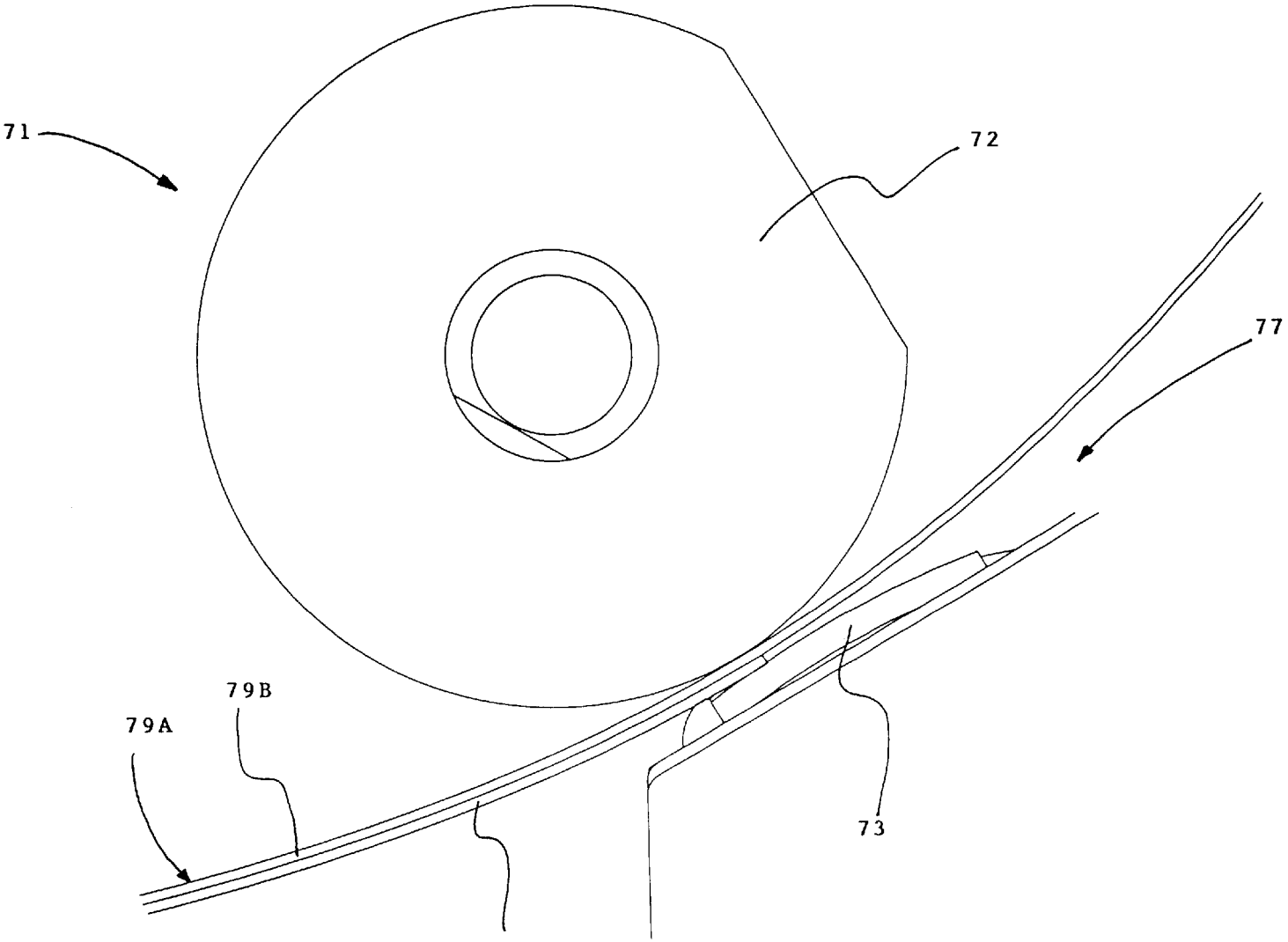
FIG. 7 is a cross sectional view of the embodiment in FIG. 1 performing the pick operation to separate the media sheet from the stack.

During the pick operation, as shown in FIG. 7, the pick roller 72 will rotate and thus may draw up two or more media sheets 79A due to the static between each of the media sheets 79A, or some other reasons, and drive these media sheets 79A forward along the media path 77. This undesirable phenomenon is known as multiple picks, and if the pick system 71 has no means to separate the media sheets 79A, the media sheets 79A will be fed to the driver roller and pinch roller (not shown) and into the printing position to receive print markings. This process may result in the media sheets 79A being jammed along the media path 77, since the media path 77 is designed to allow only one sheet of media 79A to traverse. For this reason, the separator 73 is placed right below the pick roller 72 to provide friction between the bottom surface of media sheet 79C and the upper surface of the separator 73. Since the friction between the media sheet 79B and media sheet 79C is less than the friction between media sheet 79C and the separator 73, the media sheet 79B will slide over the media sheet 79C while being driven forward by the pick roller 72. This operation will ensure that only one of media sheets 79A is fed into the printer each time.

To provide effective contact between the separator 73 and the bottom surface of the media sheet 79C, the separator 73 must protrude sufficiently above the surface of the media path 77. Since the separator 73 is located near the right edge of the media path 77, it causes the leading edge of the media sheet 79B to be raised unevenly while the media sheet 79B is being driven forward along the media path 77. Accordingly, the shape of the media sheet 79B is also altered. Since the unleveled leading edge of the media sheet 79B is not aligned to the drive roller-pinch roller entry point (not shown), further pick skew will occur as the media sheet 79B is fed to the drive roller and pinch roller. Unless the shape of the media sheet 79B is corrected prior to its entry at the drive roller and pinch roller, the media sheet 79B will stay skewed to the media path 77 at the amount caused during the pick operation.

The amount of pick skew occurring during the pick operation depends very much on the shape of the media sheet 89 with respect to the right edge of the media sheet 89, which is shown in FIG. 8. If the leading edge of the media sheet 89 can be leveled with the right edge of the media sheet 89 before being fed into the drive roller-pinch roller entry point 80, the pick skew will kept to a minimum. As such, the following measures have been adopted to level the leading edge of the media sheet 89 as it proceeds forward along the media path 87.

Postcard-size and A-Size Media Sheets

Figure 8A:
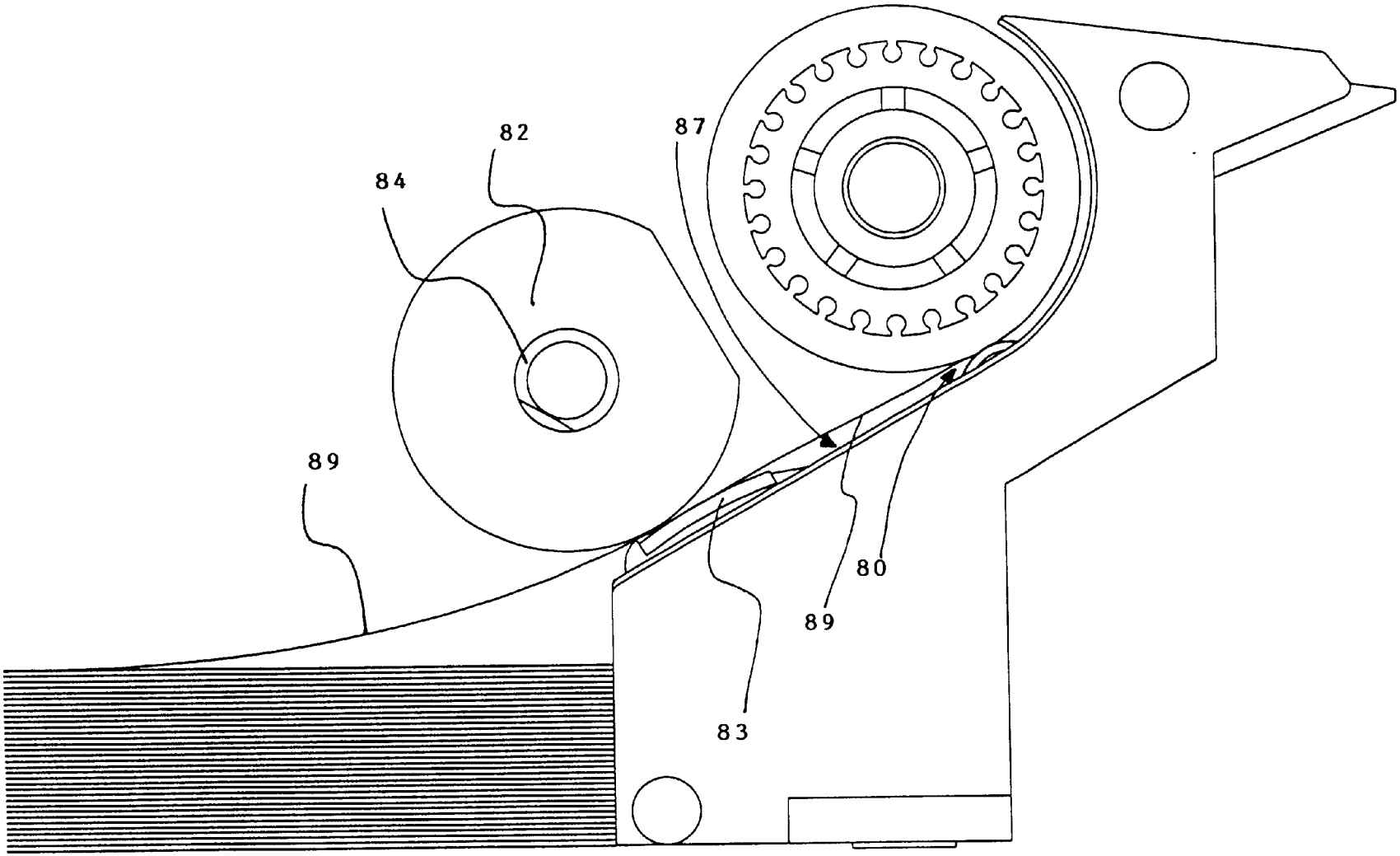
FIG. 8A is a modified cross sectional view of the embodiment in FIG. 1 driving the media sheet along the media path towards the drive roller and pinch roller.
Figure 8B:
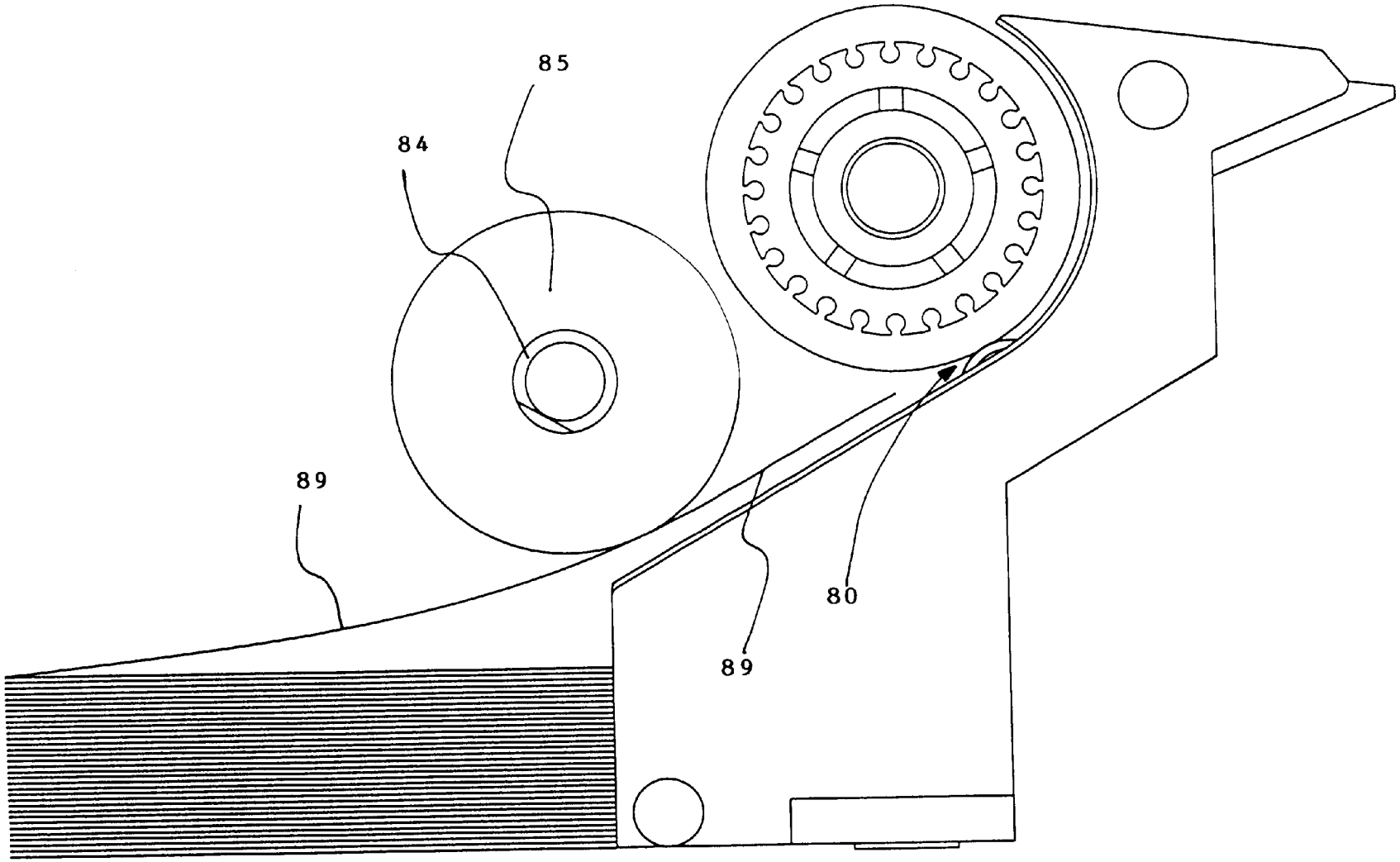
FIG. 8B is a modified sectional view of the embodiment in FIG. 3, taken along line A–A', driving the media sheet along the media path towards the drive roller and pinch roller.
Figure 8C:
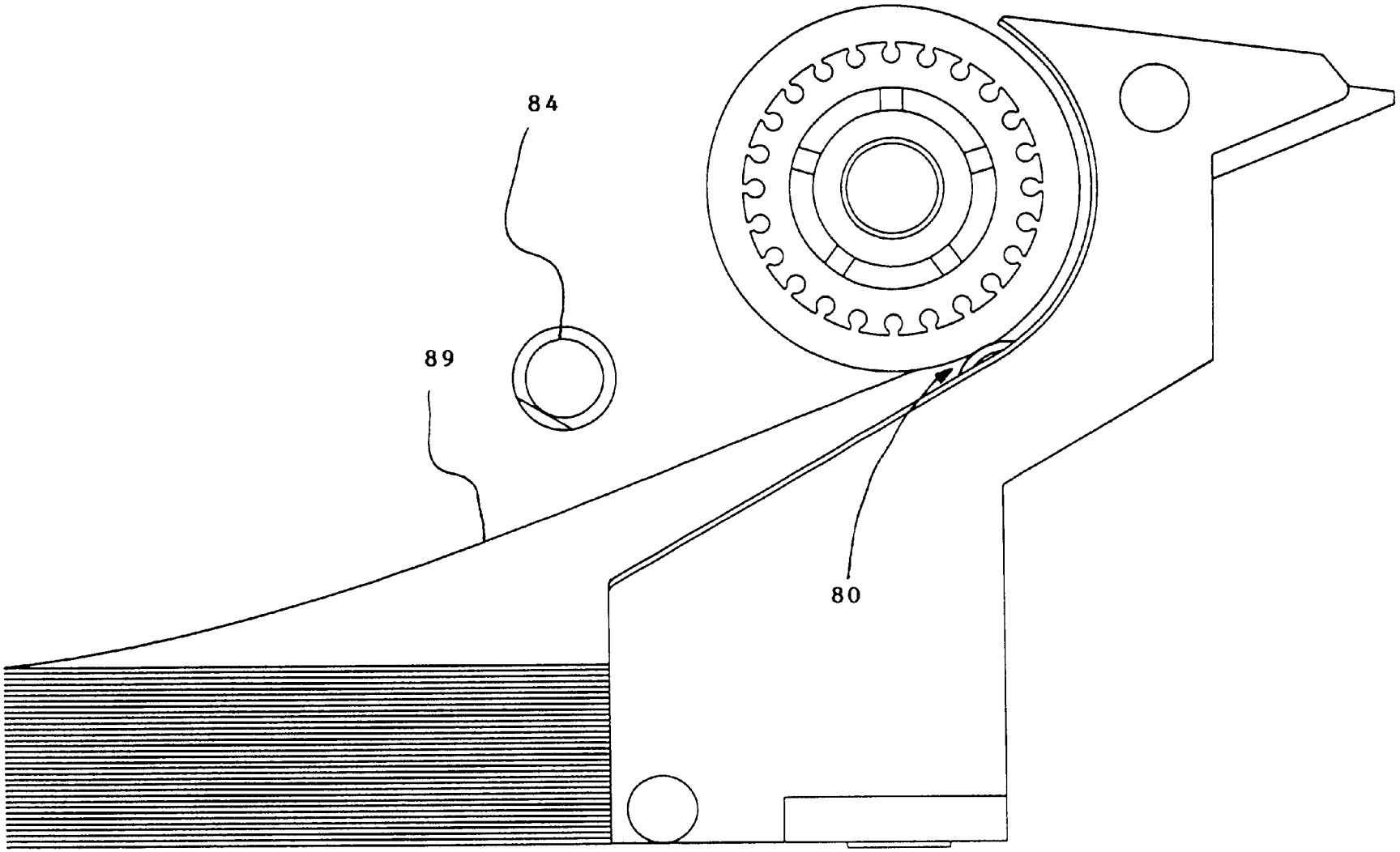
FIG. 8C is a further modified sectional view of the embodiment in FIG. 3, taken along line A–A', with the pair of idle rollers removed.

Due to the stiffness of these types of print media, the left edge of the media sheet 89, as shown in FIG. 8C, does not bend as much as the right edge of the media sheet 89 as it is picked and driven forward by the pick roller 82. This uneven bending will result in the left leading edge of the media sheet 89 reaching the drive roller-pinch roller entry point 80 later than the right leading edge of the media sheet 89. To correct the shape of the media sheet 89, a pair of idle rollers 85, each of which is strategically placed over the left edge of each of the postcard-size media sheet 89 or A-size media sheet 89 as shown in FIG. 8B, operate to conform the left edge of the media sheet 89 with the right edge by applying a downward force. As a result, the leading edge of the media sheet 89 is leveled before the media sheet 89 is fed to the drive roller-pinch roller entry point 80.

A3-size and Super B-size Media Sheets

Figure 8D:
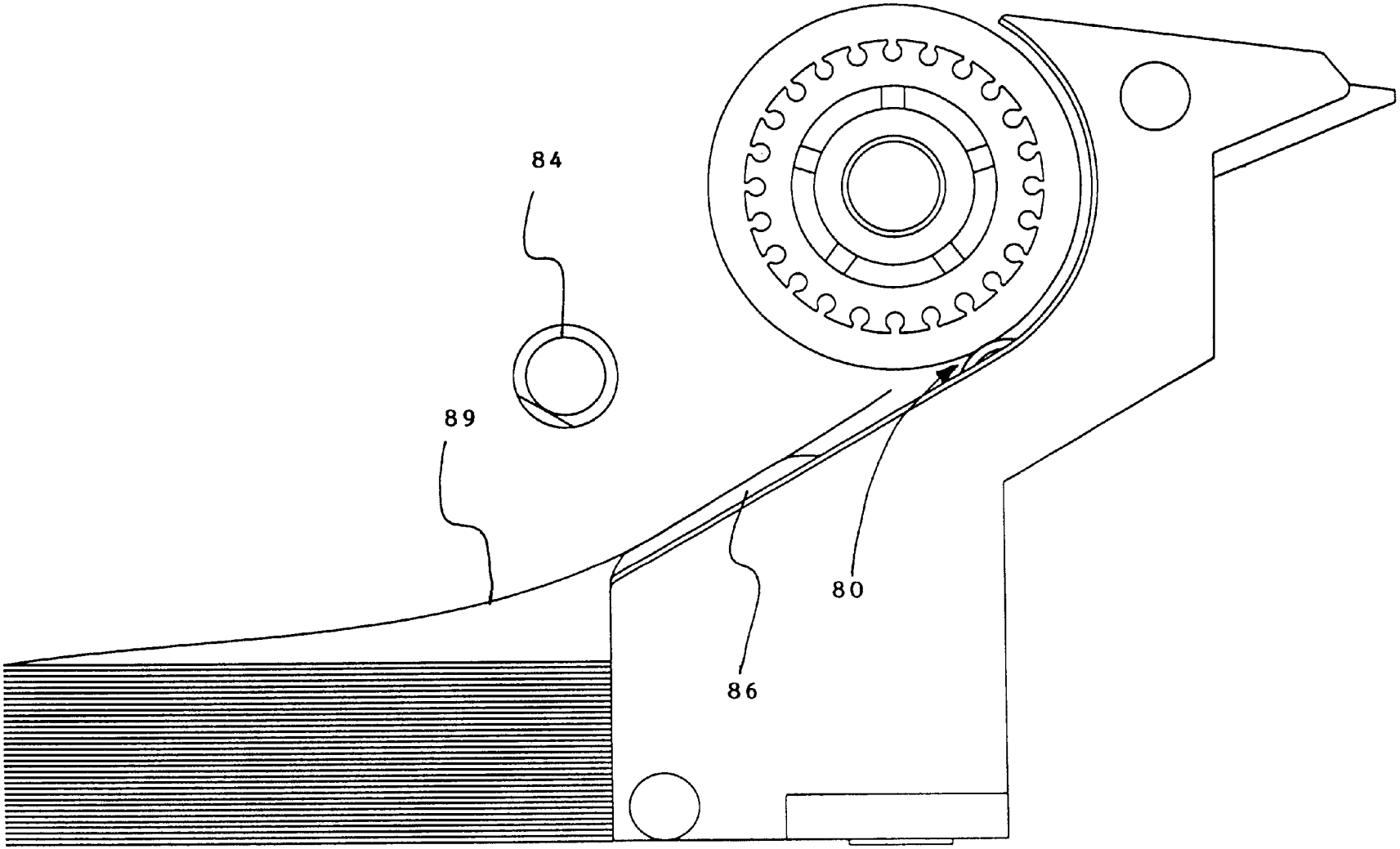
FIG. 8D is a modified sectional view of the embodiment in FIG. 5, taken along line B–B', driving the media sheet along the media path towards the drive roller and pinch roller.
Figure 8E:
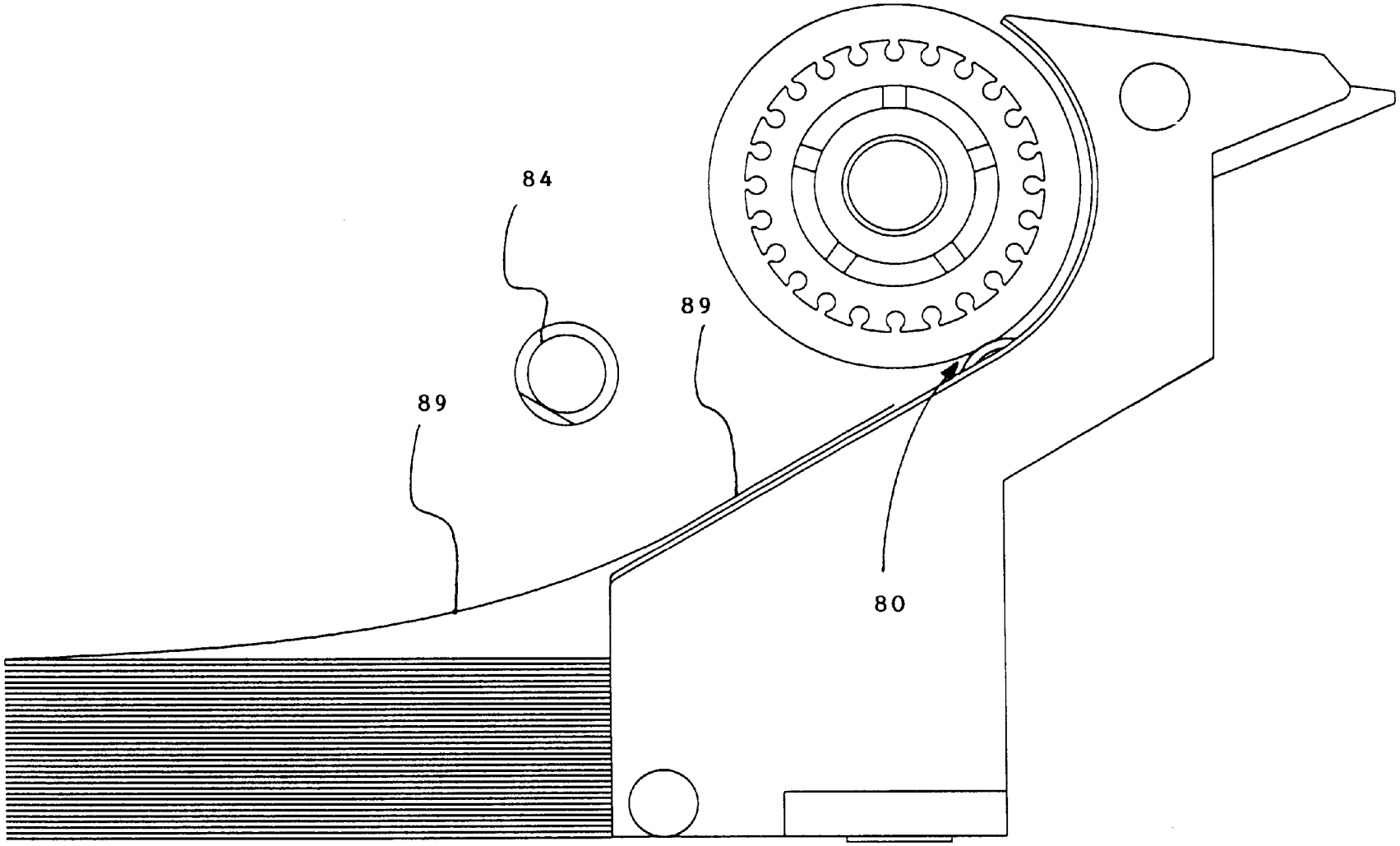
FIG. 8E is a further modified sectional view of the embodiment in FIG. 5, taken along line B–B', with the series of leveling ribs removed.

Conversely, due to the heavier weight of the A3-size media sheet 89 or Super B-size media sheet 89, the left edge of media sheet 89, as shown in FIG. 8E, bends more that the right edge of the media sheet 89 and thus rests on the surface of the media path 87. This uneven bending will again result in the left leading edge of the media sheet 89 reaching the drive roller-pinch roller entry point 80 later than the right leading edge of the media sheet 89. To correct this problem, the media path 87 under the left edge of each of the different types of media sheet 89 is raised to the same height as the separator 83. A leveled plan is thus maintained on which the media sheet 89 moves in order to facilitate the leveling of the leading edge of the media sheet 89. This is done with the help of the series of leveling ribs 86 as shown in FIG. 8D.

The preferred embodiment of the present invention described is not to be construed as limitative. For example, the series of leveling ribs used to level the leading edge of the media sheet driven through the pick system can be substituted by a series of raised planar surfaces or a series of idle rollers disposed on the surface of the media path. In another example, the separator disposed directly below the pick roller may be replaced by a flap located on one of the leading corners of the media stack. The flap operates to provide an opposing force to cause the corner of the top media sheet to buckle while being driven forward by the pick roller. The media sheet thus separates itself from the underlying media sheet. The flap may be substantially raised from the surface of the media path and thus can cause the leading edge of the media sheet to be unleveled. The resultant shape of the media sheet can accordingly be corrected by the use of the series of leveling ribs or idle rollers.

We claim:

1. An apparatus, capable of handling multiple media sizes, for picking a media sheet from a stack substantially squared to a media path and substantially eliminating the pick skew of the media sheet in a printing device, comprising:

at least one rotatably driven pick roller contacting an upper surface and a leading edge of the media sheet with the rotational axis of the pick roller oriented substantially orthogonal to the media path, whereby the pick roller rotatably drives the media sheet forward along the media path;

at least one separator protruding from a surface of the media path and cooperating with the pick roller to provide parallel and opposing forces to separate the media sheet from and slidably move the media sheet over the stack; and a plurality of leveling surfaces protruding into the media path and disposed substantially adjacent to the separator along a direction orthogonal to the media path, whereby the plurality of leveling surfaces raise a first part of the leading edge of the slidably moving media sheet from the media path to substantially level with a second part of the leading edge raised by the separator.

2. The apparatus as claimed in claim 1, wherein said leveling means comprises a plurality of leveling surfaces that protrudes from the surface of the media path and is disposed substantially adjacent to the separator along the orthogonal to the media path, the plurality of leveling surfaces raising a first part of the leading edge of the slidably moving media sheet from the surface of the media path to be substantially level with a second part of the leading edge raised by the seperator.

3. The apparatus as claimed in claim 2 wherein the plurality of the leveling surfaces comprises a plurality of leveling ribs.

4. The apparatus as claimed in claim 3 wherein each of the plurality of leveling ribs is substantially parallel to adjacent leveling ribs.

5. The apparatus as claimed in claim 4, wherein each of the plurality of leveling ribs is substantially parallel to the media path.

6. The apparatus as claimed in claim 1 further comprising a rotatably driven shaft to which the pick roller is fixed.

7. The apparatus as claimed in claim 6 wherein the shaft provides rotational transmission drive to the pick roller.

8. The apparatus as claimed in claim 1 further comprising a datum located along one of the edges of the stack to provide an opposition to a rotational force resulting from imbalancing forces exerting on the media sheet during media sheet pick.

9. An apparatus, capable of handling multiple media sizes, for picking a media sheet from a stack substantially squared to a media path and substantially eliminating the pick skew of the media sheet in a printing device, comprising:

at least one rotatably driven pick roller contacting an upper surface and a leading edge of the media sheet with the rotational axis of the pick roller oriented substantially orthogonal to the media path, whereby the pick roller rotatably drives the media sheet forward along the media path;

at least one separator protruding from a surface of the media path and cooperating with the pick roller to provide parallel and opposing forces to separate the media sheet from and slidably move the media sheet over the stack;

a rotatable driven draft to which the pick roller is fixed; and a plurality of idle rollers spaced along the shaft for lowering a first part of the leading edge of the slidably moving media sheet to substantially level with a second part of the leading edge raised by the separator.

10. The apparatus as claimed in claim 9 wherein the plurality of idle rollers freely rotating about the shaft.

11. A method, capable of handing multiple media sizes, for picking a media sheet from a stack substantially squared to a media path and substantially eliminating the pick skew of the media sheet in a printing device having at least one rotatably driven pick roller, at least one separator, and a plurality of leveling surfaces, comprising the steps of:

providing contact between an upper surface and a leading edge of the media sheet, and the pick roller to rotatably drive the media sheet forward along the media path;

providing parallel and opposing forces to separate the media sheet from the stack;

slidably moving the leading edge of the media sheet along the media path over the plurality of leveling surfaces; and raising a first part of the leading edge of the slidably moving media sheet to substantially level with a second part of the leading edge raised by the separator.

12. The method as claimed in claim 11 further comprising the step of providing an opposition to a rotational force resulting from imbalancing forces exerting on the media sheet during media sheet pick with a datum located along one of the edges of the stack.

13. The method as claimed in claim 11, wherein the step of leveling the leading edge comprises the step of raising a first part of the leading edge of the slidable moving media sheet to be substantially level with a second part of the leading edge raised by the separator.

14. A method, capable of handing multiple media sizes, for picking a media sheet from a stack substantially squared to a media path and substantially eliminating the pick skew of the media sheet in a printing device having at least one rotatable driven pick roller, and at least one separator, comprising the steps of:

providing contact between an upper surface and a leading edge of the media sheet, and the pick roller to rotatable drive the media sheet forward along the media path;

providing parallel and opposing forces to separate the media sheet from the stack;

slidably moving the leading edge of the media sheet along the media path; and lowering a first part of the leading edge of the slidably moving media sheet to substantially level with a second part of the leading edge raised by the separator with a plurality of idle rollers.

* * * * *